US010512828B2

(12) United States Patent
Su

(10) Patent No.: US 10,512,828 B2
(45) Date of Patent: Dec. 24, 2019

(54) MANUFACTURE METHOD FOR PARTIAL STRUCTURE REFINEMENT OF A FORGED IRON GOLF CLUB HEAD

(71) Applicant: Chi-Hung Su, Tainan (TW)

(72) Inventor: Chi-Hung Su, Tainan (TW)

( * ) Notice: Subject to any disclaimer, the term of this patent is extended or adjusted under 35 U.S.C. 154(b) by 176 days.

(21) Appl. No.: 15/783,262

(22) Filed: Oct. 13, 2017

(65) Prior Publication Data

US 2019/0111322 A1 Apr. 18, 2019

(51) Int. Cl.

| | |
|---|---|
| ***A63B 53/04*** | (2015.01) |
| ***B21K 17/00*** | (2006.01) |
| ***B21K 29/00*** | (2006.01) |
| ***A63B 60/00*** | (2015.01) |

(52) U.S. Cl.

CPC ..... *A63B 53/047* (2013.01); *B21K 17/00* (2013.01); *B21K 29/00* (2013.01); *A63B 2053/0408* (2013.01); *A63B 2060/002* (2015.10); *A63B 2209/00* (2013.01)

(58) Field of Classification Search

CPC .. B21K 17/00; B21K 29/00; B21J 1/06; B21J 5/00; B21J 5/06; B21J 5/063; B21J 1/00; B21J 1/02; B21J 5/022; B21J 5/025; B21D 22/022; B21D 22/02; B21D 22/208; B21D 24/16; B21D 37/063; A63B 53/047; A63B 53/0475; A63B 2053/0408; A63B 2053/0491

USPC ..... 148/639

See application file for complete search history.

(56) References Cited

U.S. PATENT DOCUMENTS

| | | | | |
|---|---|---|---|---|
| 2,560,973 | A * | 7/1951 | Martin | B21J 1/06 148/327 |
| 5,378,295 | A * | 1/1995 | Yamashita | A63B 53/04 148/654 |
| 6,440,011 | B1 * | 8/2002 | Hocknell | A63B 53/02 473/342 |
| 2007/0018356 | A1 * | 1/2007 | Nakamura | B21D 22/10 264/314 |
| 2009/0253531 | A1 * | 10/2009 | Doi | A63B 53/04 473/324 |
| 2012/0088600 | A1 * | 4/2012 | Rick | A63B 53/047 473/342 |
| 2013/0305801 | A1 * | 11/2013 | Liang | B21J 1/00 72/340 |
| 2015/0000366 | A1 * | 1/2015 | Lo | B21K 17/00 72/340 |

FOREIGN PATENT DOCUMENTS

| | | |
|---|---|---|
| JP | 2001321470 | 11/2001 |
| JP | 2002180205 | 6/2002 |
| JP | 2002360749 | 12/2002 |

(Continued)

*Primary Examiner* — Adam J Eiseman
*Assistant Examiner* — Stephen Floyd London
(74) *Attorney, Agent, or Firm* — Rosenberg, Klein & Lee

(57) ABSTRACT

A manufacture method for partial structure refinement of a forged iron golf club head includes a preparing step, a first preforming step, a second preforming step, a fine-forging shaping step, a partial structure refinement step, and a final shaping step. The manufacture method is capable of partially refining the particle structure of the final workpiece. The hardness of a hitting surface of the final workpiece is reinforced to generate clear and loud sounds and to achieve better hitting performance and experience.

5 Claims, 4 Drawing Sheets

(56) References Cited

FOREIGN PATENT DOCUMENTS

| | | |
|---|---|---|
| JP | 2003144591 | 5/2003 |
| JP | 2004292906 | 10/2004 |
| JP | 2004305336 | 11/2004 |
| JP | 2004357849 | 12/2004 |
| JP | 200536280 | 2/2005 |
| JP | 2012152232 | 8/2012 |
| JP | 2013128765 | 7/2013 |
| JP | 201577399 | 4/2015 |
| JP | 20163395 | 1/2016 |

* cited by examiner

MANUFACTURE METHOD FOR PARTIAL STRUCTURE REFINEMENT OF A FORGED IRON GOLF CLUB HEAD

BACKGROUND OF THE INVENTION

1. Field of the Invention

The present invention relates to a manufacture method of a golf club, and particularly to a manufacture method for partial structure refinement of a forged iron golf club head.

2. Description of Related Art

A conventional forging manufacture process to forge an iron head of a golf club includes multiple forging steps and air-cooling in each forging step to stabilize the particle structure of the forged iron head and to keep the quality consistent. However, the consistent particle structure of the iron head makes the strength of iron head mediocre and the hitting sounds monotonous.

Therefore, to improve hitting performances or hitting sounds of the conventional iron head, the manufacture method may adopt weights engaged in the iron head or forging with different materials. The foresaid manufacture method will produce an iron head having different materials or may increase the production cost.

To overcome the shortcomings of the conventional manufacture method of an iron golf club head, the present invention provides a manufacture method for partial structure refinement of a forged iron golf club head.

SUMMARY OF THE INVENTION

To solve the problems that the conventional manufacture method of an iron golf club head produces an iron golf club head made of different materials or increase the production cost, the present invention provides a manufacture method for partial structure refinement of a forged iron golf club head.

The manufacture method for partial structure refinement of a forged iron golf club head includes a preparing step, a first preforming step, a second preforming step, a fine-forging shaping step, a partial structure refinement step, and a final shaping step.

The manufacture method is capable of partially refining the particle structure of the final workpiece. The hardness of a hitting surface of the final workpiece is increased to generate clear and loud sounds and to achieve better hitting performance and experience.

DETAILED DESCRIPTION OF PREFERRED EMBODIMENT

With reference to FIGS. 1 to 4, a preferred embodiment of a manufacture method for partial structure refinement of a forged iron golf club head in accordance with the present invention includes a preparing step S1, a first preforming step S2, a second preforming step S3, a fine-forging shaping step S4, a partial structure refinement step S5, and a final shaping step S6.

Figure 1:
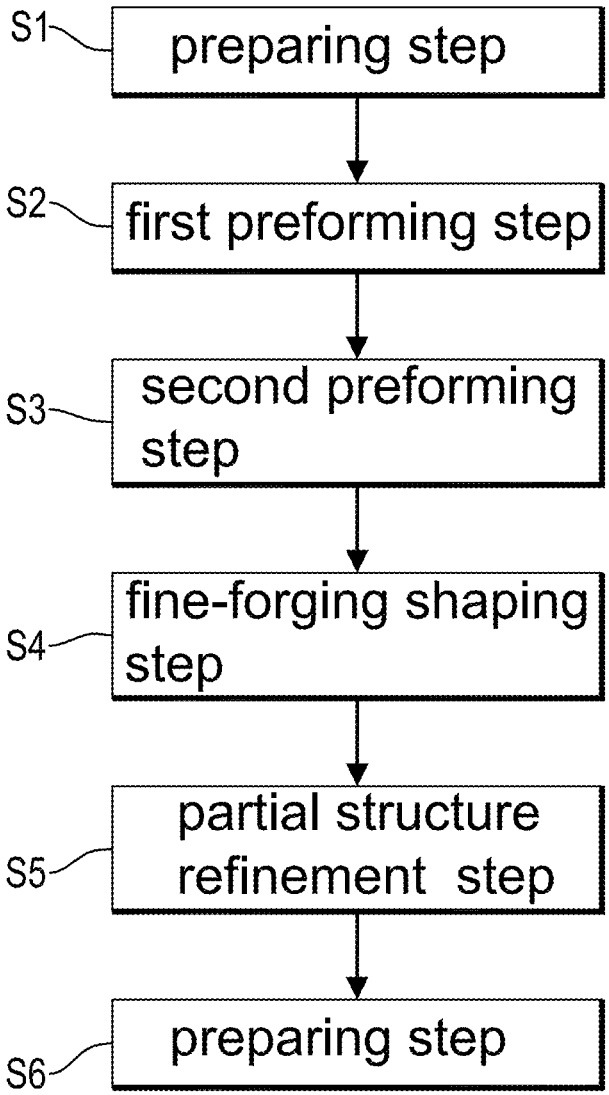
FIG. 1 is a block diagram of a manufacture method for partial structure refinement of a forged iron golf club head in accordance with the present invention.
Figure 2:
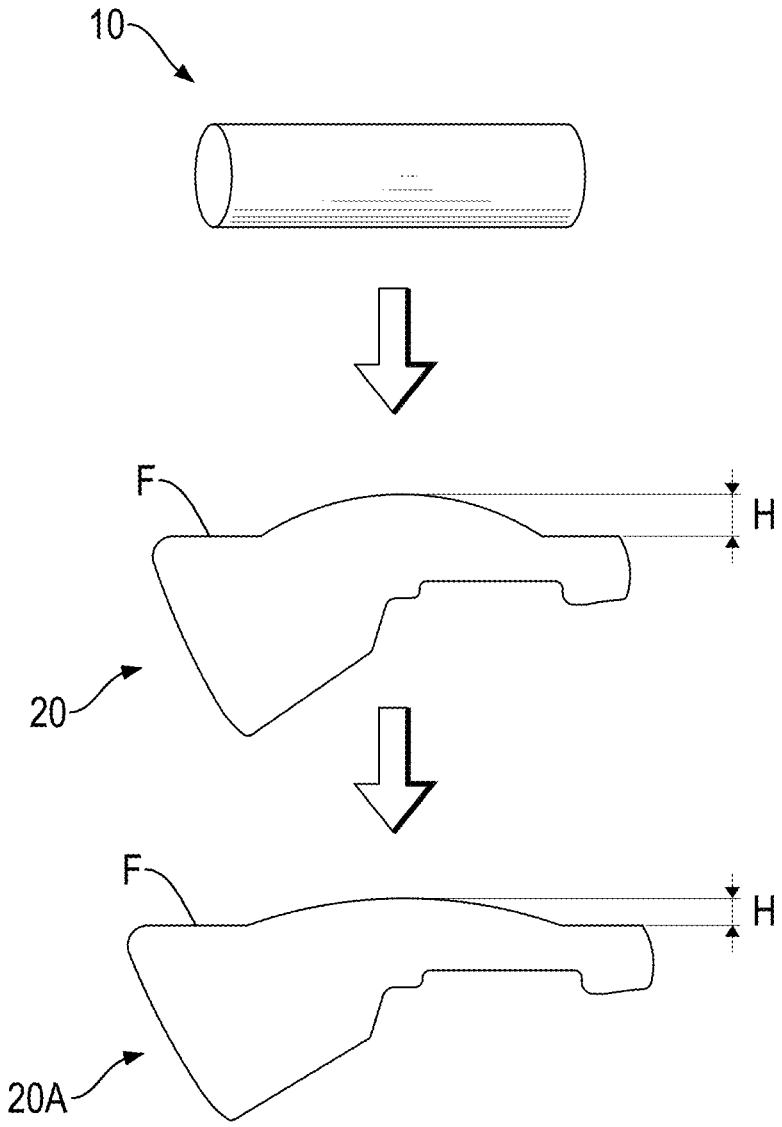
FIG. 2 shows operational cross-sectional views of the manufacture method in FIG. 1, showing steps S1 to S3 in order.

With reference to FIGS. 1 and 2, in the preparing step S1, a bar 10 with a suitable length is prepared, and the material of the bar 10 adopts low-carbon steel or medium-carbon steel for forging.

With reference to FIGS. 1 and 2, in the first preforming step S2, the bar 10 is heated to 900 to 1100° C. And then the heated bar 10 is placed into a preforming mold to process a first preforming forging and to form a preformed workpiece 20. The preformed workpiece 20 has a sweet-spot height H defined at a hitting surface F protruding from the middle of the preformed workpiece 20. The sweet-spot height H is around 5 to 10 mm in this step. After forged, the preformed workpiece 20 is cooled in air until the next step.

With reference to FIGS. 1 and 2, in the second preforming step S3, the aforesaid preformed workpiece 20 in the preceding step is heated to 900 to 1000° C. and is placed into the preforming mold again and treated with a second preforming process to form a preformed workpiece 20A. The sweet-spot height H is decreased to 3 to 5 mm by forging. After forged, the preformed workpiece 20A is cooled in air until the next step.

Figure 3:
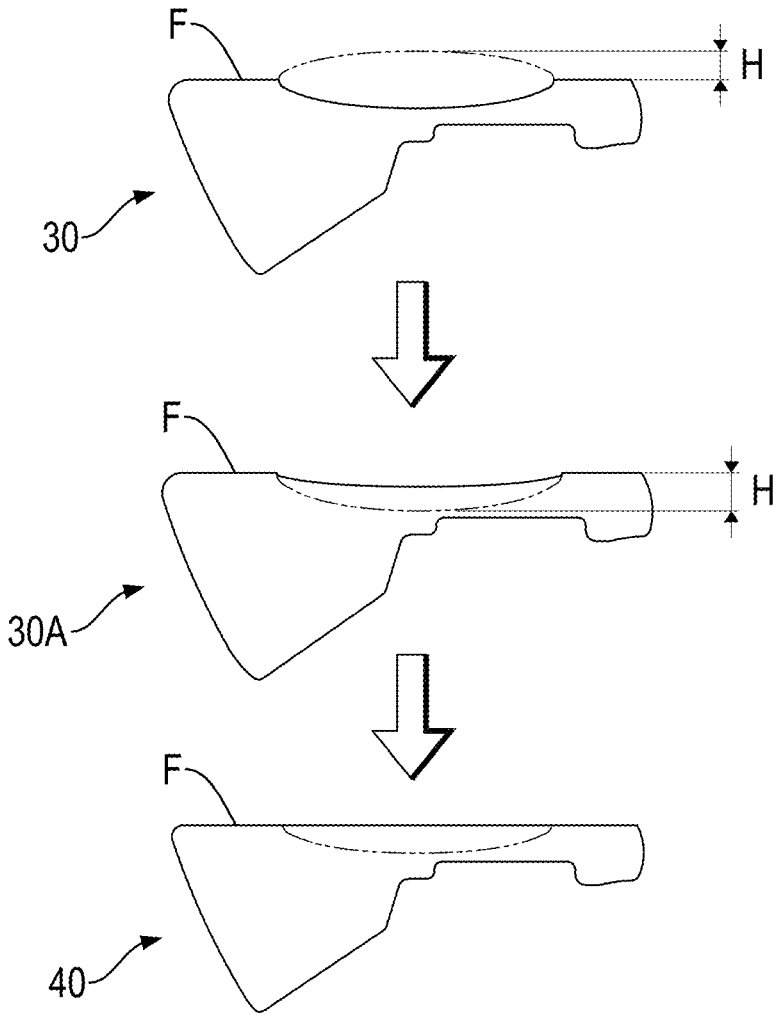
FIG. 3 shows operational cross-sectional views of the manufacture method in FIG. 1, showing steps S4 to S6 in order.

With reference to FIGS. 1 and 3, in the fine-forging shaping step S4, the aforesaid preformed workpiece 20A is heated to 700 to 1000° C., placed into a fine-forging mold, and treated with a fine-forging process to form a fine-forged workpiece 30. The fine-forged workpiece 30 also has the sweet-spot height H as the preformed workpiece 20A. The sweet-spot height H is decreased to 2 to 4 mm by forging. After forged, the fine-forged workpiece 30 is cooled by quenching. The particle structure of the fine-forged workpiece 30 is in the refinement status by the quenching process into the next step.

With reference to FIGS. 1 and 3, in the partial structure refinement step S5, the whole piece of the fine-forged workpiece 30 is heated to 300° C. to 600° C. Then a partial heating method is acted to heat the middle of the hitting surface F of the fine-forged workpiece 30 to 400 to 900° C. The partial heating method can be heated by electrical coils, by a flamethrower or any other means that can process heating of a partial area. Preferably, the partial heating method in this embodiment is done by electrical coils.

After heating the fine-forged workpiece 30, the fine-forged workpiece 30 is placed into a second fine-forging mold and treated with a second fine-forging process to form a fine-forged workpiece 30A. The hitting surface F is downwardly concave due to the design of the mold and the partial heating method. The sweet-spot height H is 1 to 4 mm downward from the hitting surface F. After forged, the fine-forged workpiece 30A is cooled by quenching. The particle structure of the fine-forged workpiece 30A is in refinement again to make the particle structure of the fine-forged workpiece 30A smaller and fragmental.

Figure 4:
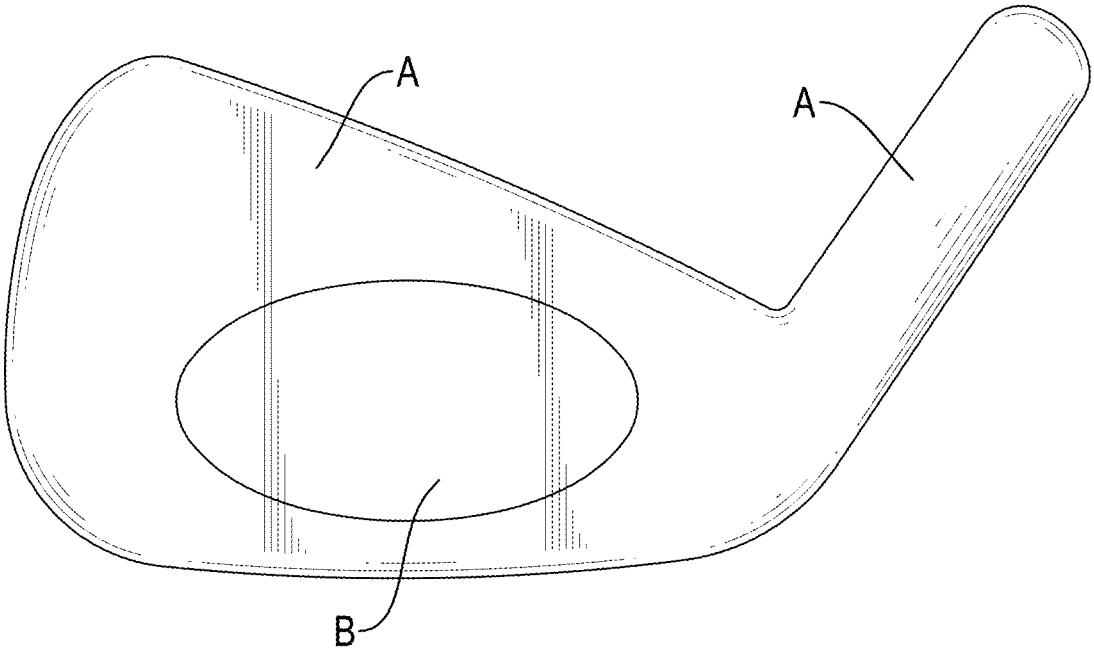
FIG. 4 is a side view of a final workpiece of the manufacture method in FIG. 1.

With reference to FIGS. 1, 3, and 4, in the final shaping step S6, the fine-forged workpiece 30A formed in the preceding step is heated to 700 to 1000° C. and is placed into a shaping mold and treated with a third fine-forging process to become a final workpiece 40. Because the cavity of the shaping mold is smaller than the fine-forged workpiece 30A, the fine-forged workpiece 30A is squeezed in the shaping mold to make the concave hitting surface F of the fine-forged workpiece 30A filled upwardly in the shaping mold. Thus, the hitting surface F of the final workpiece 40 is level with the surrounding area of the hitting surface F of the final workpiece 40 as shown in FIG. 4. After forged, the final workpiece 40 is cooled by quenching. The particle structure of the final workpiece 40 is refined by multiple times of material flow and post-treatment such as quenching.

With reference to FIG. 4, the manufacture method of the present invention is capable of forming a partially refined particle structure of the final workpiece 40. In the metallographic structure of the final workpiece 40 in a non-hitting area A, the ferrite particles of the final workpiece 40 are large and the pearlite particles of the final workpiece 40 are dispersed evenly. In the metallographic structure of the final workpiece 40 in a hitting area B, the ferrite particles of the final workpiece 40 are fragmental, refined and smaller than those of the non-hitting area A of the final workpiece 40 and are dispersed over a wide area, and the pearlite particles of the final workpiece 40 are dispersed in a more scattering manner. Therefore, the hardness of the hitting surface F of the final workpiece 40 is increased to generate clear and loud sounds and to achieve better hitting performance and experience.

Even though numerous characteristics and advantages of the present invention have been set forth in the foregoing descriptions, together with details of the structure and function of the present invention, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A manufacture method for partial structure refinement of a forged golf club head, the method comprising:

a preparing step, preparing a bar made of carbon steel;

a first preforming step, heating the bar of the preparing step to 900 to 1100° C., forging the bar after heating to form a preformed workpiece with a sweet-spot height defined from a middle of the preformed workpiece and being a positive value, and cooling the preformed workpiece by air;

a second preforming step, heating the preformed workpiece to 900 to 1100° C., forging the preformed workpiece again after heating to decrease the sweet-spot height, and cooling the preformed workpiece by air;

a fine-forging shaping step, heating the preformed workpiece of the second preforming step to 700 to 1000° C., forging the preformed workpiece of the second preforming step again after heating to form a fine-forged workpiece, and cooling the fine-forged workpiece by quenching, wherein a sweet-spot height of the fine-forged workpiece is lower than that of the preformed workpiece of the second preforming step;

a partial structure refinement step, heating the whole fine-forged workpiece to 300 to 600° C., and heating a middle of the fine-forged workpiece to 400 to 900° C. by a partial heating method, forging the fine-forged workpiece after the partial heating to concave the middle of the fine-forged workpiece, and cooling the fine-forged workpiece by quenching; and a final shaping step, heating the fine-forged workpiece of the partial structure refinement step to 700 to 1000° C., forging the fine-forged workpiece after heating to form a final workpiece, and cooling the final workpiece by quenching, wherein a hitting surface of the final workpiece is level with a sweet spot height of the final workpiece.

2. The manufacture method as claimed in claim 1, wherein the sweet-spot height is 5 to 10 mm in the first preforming step.

3. The manufacturing method as claim in claim 2, wherein the sweet-spot height is 5 to 10 mm in the second preforming step; and wherein the sweet-spot height in the second preforming step is less than the sweet-spot height in the first preforming step.

4. The manufacture method as claimed in claim 3, wherein the sweet-spot height is 2 to 4 mm in the fine-forging shaping step.

5. The manufacture method as claimed in claim 4, wherein the sweet-spot height of the fine-forged workpiece is −1 to −4 mm from the hitting surface.

* * * * *